US007392927B2

(12) United States Patent
Zhao et al.

(10) Patent No.: US 7,392,927 B2
(45) Date of Patent: Jul. 1, 2008

(54) COMBINATORIAL PRODUCTION OF MATERIAL COMPOSITIONS FROM A SINGLE SAMPLE

(75) Inventors: Ji-Cheng Zhao, Latham, NY (US); Melvin Robert Jackson, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 146 days.

(21) Appl. No.: 10/249,548

(22) Filed: Apr. 17, 2003

(65) Prior Publication Data

US 2004/0206803 A1 Oct. 21, 2004

(51) Int. Cl.
*B23K 20/00* (2006.01)

(52) U.S. Cl. ..... 228/103; 228/193; 228/194

(58) Field of Classification Search ..... 228/193, 228/103, 194; 422/100, 102; 427/8, 402, 427/407.1; 435/7.1

See application file for complete search history.

(56) References Cited

U.S. PATENT DOCUMENTS

| | | | | |
|---|---|---|---|---|
| 3,708,866 | A * | 1/1973 | Wells | 228/194 |
| 3,894,677 | A * | 7/1975 | La Iacona | 228/190 |
| 4,529,452 | A * | 7/1985 | Walker | 148/527 |
| 4,847,044 | A * | 7/1989 | Ghosh | 419/8 |
| 4,890,784 | A * | 1/1990 | Bampton | 228/194 |
| 5,106,012 | A * | 4/1992 | Hyzak et al. | 228/265 |
| 6,286,750 | B1 * | 9/2001 | Iwadachi | 228/118 |
| 6,720,088 | B2 * | 4/2004 | Zhao et al. | 428/615 |
| 6,746,782 | B2 * | 6/2004 | Zhao et al. | 428/632 |
| 7,261,753 | B2 * | 8/2007 | Yamamoto et al. | 51/309 |
| 2001/0053530 | A1 | 12/2001 | Klein et al. | |
| 2002/0176927 | A1 | 11/2002 | Kodas et al. | |
| 2004/0126612 | A1 * | 7/2004 | Shinkai et al. | 428/627 |
| 2005/0147150 | A1 * | 7/2005 | Wickersham et al. | 374/120 |
| 2006/0065701 | A1 * | 3/2006 | Kobayashi | 228/193 |
| 2006/0222043 | A1 * | 10/2006 | Cahill | 374/447 |
| 2006/0292845 | A1 * | 12/2006 | Chiang et al. | 438/597 |
| 2006/0292846 | A1 * | 12/2006 | Pinto et al. | 438/597 |
| 2007/0269611 | A1 * | 11/2007 | Xiang et al. | 427/555 |

OTHER PUBLICATIONS

Xiang et al., "A Combinatorial Approach to Materials Discovery", Science, vol. 268, Jun. 23, 1995, pp. 1738-1740.

Briceño et al., "A Class of Cobalt Oxide Magnetoresistance Materials Discovered with Combinatorial Synthesis" http://www.sciencemag.org/cgi/content/abstract/270/5234/273?ijkey=1d206479539ec7a0b3e7d . . . 2 pages, no date avail.

Danielson et al., "A Rare-EArth Phosphor Containing One-Dimensional Chains Identified Through Combinatonial Methods", Science, vol. 279, Feb. 6, 1998, pp. 837-839.

(Continued)

*Primary Examiner*—Kiley Stoner
(74) *Attorney, Agent, or Firm*—Fletcher Yoder

(57) ABSTRACT

A combinatorial process for production of material libraries from a single sample, comprising forming a diffusion multiple in the single sample, wherein the diffusion multiple comprises a plurality of interdiffusion regions at interfacial locations of dissimilar metals, metal oxides, or alloys, and wherein the diffusion multiple comprises at least three layers of the metals, non-metals, metal oxides, or alloys; and evaluating properties of the diffusion multiple as a function of composition at about the interdiffusion regions.

21 Claims, 9 Drawing Sheets

OTHER PUBLICATIONS van Dover et al., "Discovery of a Useful Thin-Film Dielectric Using a Composition-Spread Approach", Nature, vol. 392, Mar. 12, 1998, pp. 162-164.

Senkan, "High-Throughput Screening of Solid-State Catalyst Libraries", Nature, vol. 394, Jul. 23, 1998, pp. 350-353.

Zhanpeng, "A Study of the Range of Stability of σ Phase in Some Ternary Systems", Scandinavian Journal of Metallurgy 10 (1981) pp. 279-287.

Zhao et al., Determination of Phase Equilibria in the Ti-Fe-Co System at 900° C., Z. Metallkde, Bd. 81 (1990) H. 4, pp. 247-250.

Oliver et al., "An Improved Technique for Determining Hardness and Elastic Modulus Using Load and Displacement Sensing Indentation Experiments", J. Mater. Res., vol. 7, No. 6, Jun. 1992, pp. 1564-1583.

Zhao et al., "Diffusion Quadruples for the Determination of Quaternary Phase Diagrams Applied to FeCoNiCr System", Scripta Metallurgica, vol. 22, 1988, pp. 1825-1829.

Olson, "Computational Design of Heirarchically Structured Materials", Science, vol. 277, Aug. 29, 1997. pp. 1237-1242.

VI Phase Identification: A Study of Reactions Between Members in a Multi-Component System® HKL Technology-2001 (4 pages), no date avail.

Zhao, "A Combinatorial Approach for Structured Materials", Advanced Engineering Materials 2001, 3, No. 3, pp. 143-147.

Zhao, "A Combinatorial Approach for Efficient Mapping of Phase Diagrams and Properties", J. Mater. Res., vol. 16, No. 6, Jun. 2001, pp. 1565-1578.

Ji-Cheng Zhao et al., A Diffusion Multiple Approach For The Accelerated Design Of Structural Materials, MRS BULLETIN 27, (4), Apr. 2002, pp. 324-329.

Ji-Cheng Zhao et al., Diffusion Quadruples For The Determination Of Quaternary Phase Diagrams Applied To FeCoNiCr System, SCR. Metall. 22 (12), Dec. 1998, pp. 1825-1829.

J-C Zhao et al., Alloying And Phase Stability In Niobium Silicide In-Situ Composites, Structural Intermetallics 2001, pp. 483-491.

* cited by examiner

COMBINATORIAL PRODUCTION OF MATERIAL COMPOSITIONS FROM A SINGLE SAMPLE

BACKGROUND

This disclosure generally relates to a process for the combinatorial production of material compositions from a single sample, and more particularly, to a process which employs the use of diffusion multiples to create large numbers of compositions in the single sample.

Structural materials such as superalloys and steels provide the mechanical properties for building jet engines, power generation turbines, cars, and the like. Significant time and effort is typically required to discover and optimize new compounds. One of the problems affecting the rate of development is that it is oftentimes very difficult to predict the physical and chemical properties of various compounds or material combinations, particularly for compounds or material combinations that have been produced using different processing conditions. Traditionally, most of these properties and/or behaviors are evaluated one at a time from individual alloys or by the use of binary systems, i.e., diffusion couples. A diffusion couple generally comprises two dissimilar materials, e.g., metals, metal alloys, ceramics, and the like, that are placed in good thermodynamic contact with one another. The materials are then heated at an elevated temperature for a defined period of time. An alloy interdiffusion region will exist in location of the couple, where atoms have diffused into one another. Diffusion couples, which can provide greater amounts of data than analysis of individual alloys, have been used to determine phase diagrams and evaluate diffusion coefficients.

Extending the concept from the binary systems into multi-component systems, a diffusion multiple has been employed to generate libraries of multi-component compositions for combinatorial surveys of critical materials. Generally, a diffusion multiple is an assembly of three to four different metal (or ceramic) blocks, in intimate interfacial contact, and subjected to a high temperature to allow thermal interdiffusion. The diffusion multiple is typically fabricated by inserting quarter pie shapes of metals or metal oxides into a cylindrical sleeve of a pure metal. The cylindrical sleeve is then capped at both ends with the pure metal and the entire assembly is heated at an elevated temperature for a defined period of time to promote interdiffusion at the various interfaces defined by the quarter-pie shapes. As such, the data available by the diffusion multiple arrangement and geometry as described above, while a significant advance over one-at-a-time analysis and the use of binary systems, still tends to be limited.

Accordingly, there remains a need for more versatile diffusion multiple arrangements and geometries for providing even greater amounts of data.

BRIEF SUMMARY

Disclosed herein is a combinatorial process for production of material compositions from a single sample. The process comprises assembling a bulk diffusion multiple of at least three layers comprising metals, nonmetals, metal oxides or alloys, into an arrangement; heating the arrangement at an elevated temperature and for a period of time effective to form interdiffusion regions at interfacial locations of dissimilar metals, non-metals, metal oxides, or alloys in the arrangement; exposing the interdiffusion region; and evaluating properties of the single sample as a function of composition at the interdiffusion regions.

In another embodiment, a combinatorial process for production of material libraries from a single sample comprises forming a diffusion multiple in the single sample, wherein the diffusion multiple comprises a plurality of interdiffusion regions at interfacial locations of dissimilar metals, non-metals, metal oxides, or alloys, and wherein the diffusion multiple comprises at least three layers of the metals, non-metals, metal oxides, or alloys; and evaluating properties of the diffusion multiple as a function of composition at about the interdiffusion regions.

A process for forming a diffusion multiple comprises layering at least three metals and/or non-metals and/or alloys and/or metal oxides to form a stack, wherein the stack comprises a plurality of interfacial contact surfaces of dissimilar metals, non-metals, metal alloys, and/or metal oxides; inserting the stack into a slot formed in a pure metal disk, wherein the stack accommodates dimensions of the slot; and heating the pure metal disk to a temperature and for a period of time to form a plurality of interdiffusion regions at about the interfacial contact surfaces of the dissimilar metals, non-metals, metal oxides, and/or alloys The above described and other features are exemplified by the following detailed description and figures.

DETAILED DESCRIPTION

Figure 1:
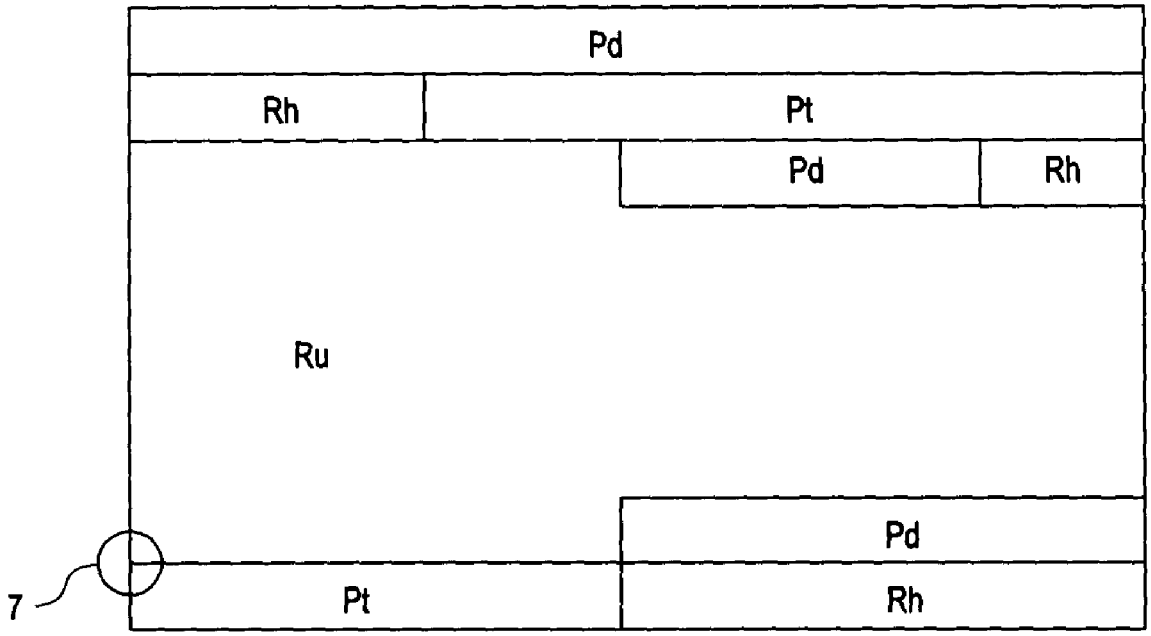
FIG. 1 illustrates an arrangement of a diffusion multiple made up of Pd, Pt, Rh and Ru foils.

Disclosed herein is a combinatorial process for structural materials development. The term "structural materials" includes metal, nonmetals, alloys, intermetallics, and/or ceramics. The process employs the use of bulk diffusion multiples of various structural materials to create large libraries of compositions in the diffusion multiple for a fast and systematic survey of properties for these compositions. Advantageously, it has been found that the properties obtained for the compositions using the process correspond with bulk property behavior. That is, unlike thin film approaches, properties such as precipitation kinetics and diffusion coefficients can be evaluated using bulk diffusion multiples having layers at a thickness effective to correspond with bulk property behavior. The usually small grain size of thin films is known to confound solution-hardening and precipitation-hardening effects. Moreover, the intermetallic compounds formed in the bulk diffusion multiples are more often the equilibrium phases, whereas those in thin film are quite often metastable phases.

As used herein, the term "bulk diffusion multiple" refers to an assembly of three or more different structural material blocks or layers, in intimate facial contact, arranged as a triple, quadruple, or higher order, and subjected to a high temperature to allow thermal interdiffusion. The arrangement and geometry of the bulk diffusion multiple provides greater amounts of information than previously possible. In a preferred embodiment, the term diffusion multiple refers to an assembly of three or more structural metal blocks or layers or foils arranged as a triple, quadruple, or higher order arrangement. The properties for the various compositions produced in the bulk diffusion multiple can be analyzed using microanalytical techniques such as electron probe microanalysis, electron backscattering pattern diffraction analysis, nanoindentation tests, and the like. The results can then be used to provide an efficient survey of the various crystal phases for the compositions, equilibria, precipitation kinetics, properties, as well as insight into composition-structure-property relationships for accelerated development of multi-component alloys and ceramics. Moreover, the data can provide compositional information for electrical conductivity properties, magnetic properties, piezoelectric properties, optical properties, lattice parameters, thermal conductivity properties, corrosion properties, oxidation properties, carburization rates, or combinations comprising at least one of the foregoing properties.

The process generally comprises annealing the bulk diffusion multiples of dissimilar metals, metal oxides, or metal alloys at an elevated temperature and for a defined period of time to form interdiffusion regions; and cooling the annealed sample to room temperature at a defined cooling rate. The annealing temperatures and times will depend on the bulk diffusion multiple configurations, the material types, and the extent of interdiffusion desired. Preferably, the bulk diffusion multiple is sealed under vacuum of about 1 nanotorr to about 1 millitorr. During the annealing and cooling steps, the various alloy compositions formed by thermal interdiffusion between the dissimilar materials at the couple locations can be microanalytically inspected, e.g., electron probe microanalysis, electron backscattering pattern diffraction analysis, nanoindentation tests, and the like. Phase regions and equilibria information can then be obtained for the various compositions that occur as a function of distance from the couple location. The term "couple location" refers to a region within the diffusion multiple about where dissimilar metals initially contact another metal.

Crystal structure identification of all phases can be made using electron backscatter diffraction (EBSD) and electron probe microanalysis (EPMA), and trends in mechanical behavior can be mapped using nanoindentation techniques, which techniques are generally known by those skilled in the art. EBSD is an electron diffraction technique that allows rapid electron diffraction collection from small microstructural features using scanning electron microscopy. Phase identification can then be accomplished by a direct match of the diffraction bands (similar to Kikuchi bands) in the experimental pattern with simulated patterns generated using known structure types and lattice parameters. In electron probe analysis, intermetallic compound analysis can be made. Nanoindentation is suitable for load and penetration depth measurements at nanometer length scales, thereby providing measurement of properties such as hardness and Young's Modulus. The solution hardening and softening effects, as well as the modulus behavior, contain a great amount of information about the elemental interaction, i.e., bonding, non-linear solid-state interaction, and the like.

As previously described, the use of bulk diffusion multiples can be used to provide combinatorial surveys of ternary, quaternary, or higher order system. For example, a bulk diffusion multiple was made by cutting a slot 1.8 millimeter (mm) wide and 12.7 mm long from a 25 mm diameter pure chromium disc of 3 mm thickness. Pure palladium, platinum, and rhodium foils of 0.25 mm thickness were arranged in the geometry as shown in FIG. 1 and put into the slot in the chromium disc along with a pure ruthenium piece with two steps on it. The ruthenium piece had a thickness of 1 mm on one side and 0.5 mm on the other. Two pure chromium discs (without the slot) of 25 mm diameter and 3 mm thickness were placed on top and bottom of the slotted chromium disk containing all the precious metals. The assembly was then placed in a hot isostatic pressing (HIP) can made up of commercially pure titanium and sealed in a vacuum using electron beam welding. The whole assembly then underwent an HIP run of 1,200° C. at 200 megapascals (MPa) for 4 hours. The diffusion multiple was further annealed at 1,200° C. for an additional 36 hours making the total diffusion time of 40 hours.

Figure 2:
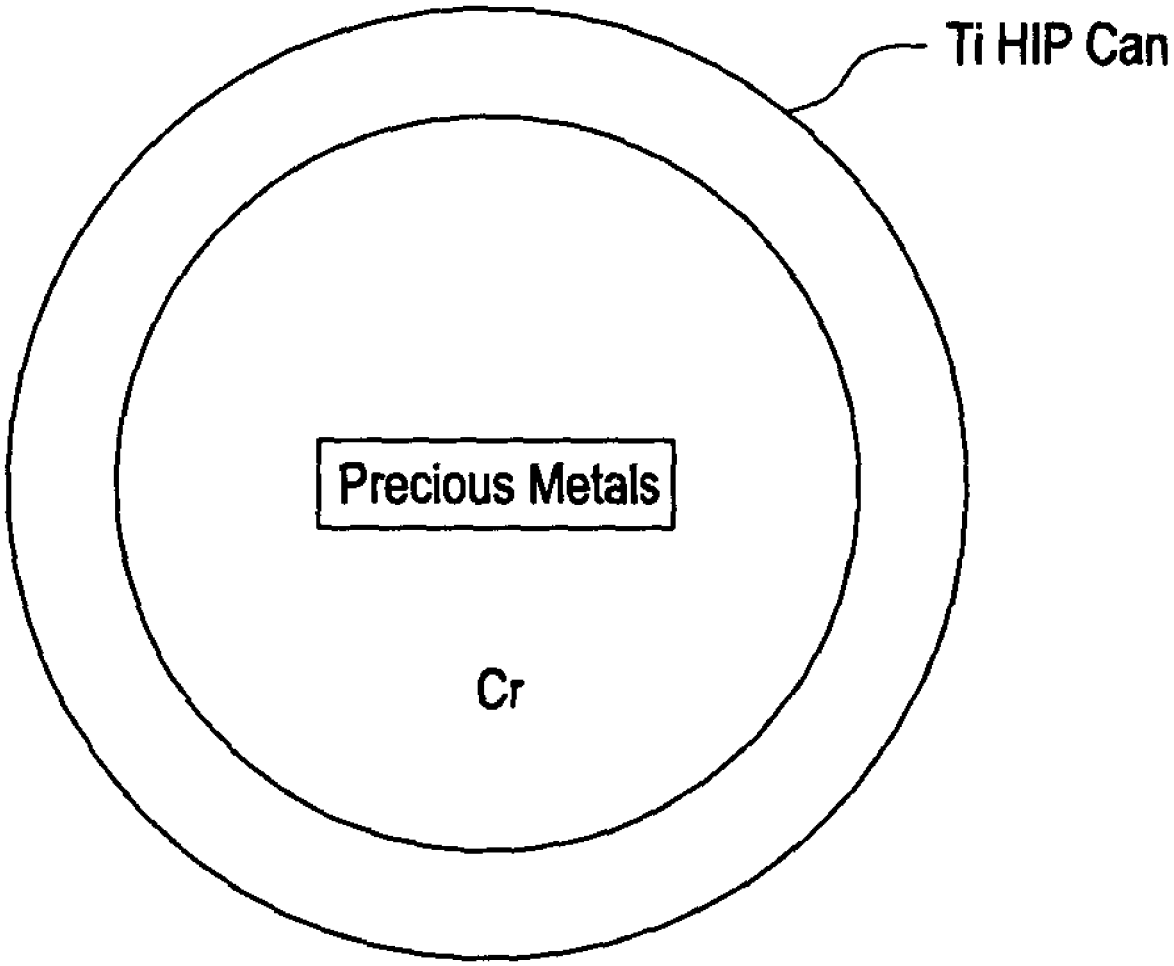
FIG. 2 pictorially illustrates a top plan view of the diffusion multiple of FIG. 1.

The annealed bulk diffusion multiple was then cut into halves parallel to the broad (25 mm diameter) faces of the slotted chromium piece and in the middle of the thickness direction. The sample was then ground and polished for electron probe microanalysis, electron backscatter diffraction analysis, and nanoindentation tests. Nanoindentation was performed using a Hysitron instrumented indenter, commercially available from Hysitron, Inc., Minneapolis. FIG. 2 pictorially illustrates a top plan view of the diffusion multiple.

Optionally, after cutting, grinding, and polishing the exposed interdiffusion region, the interdiffusion region may then be treated with a reactant to provide a new spectrum of compositions. The reactants interact with the phases and compositions in the interdiffusion region to produce new compositions. The types and amounts of reactants are not intended to be limited. Suitable reactants include oxygen, nitrogen, hydrogen, carbon, boron, aluminum and the like. The properties of the reactants can be examined in the same manner as the multiples formed by the combinatorial process, provided the reactant layer is thick enough to be characterized by the evaluation techniques.

Figure 3:
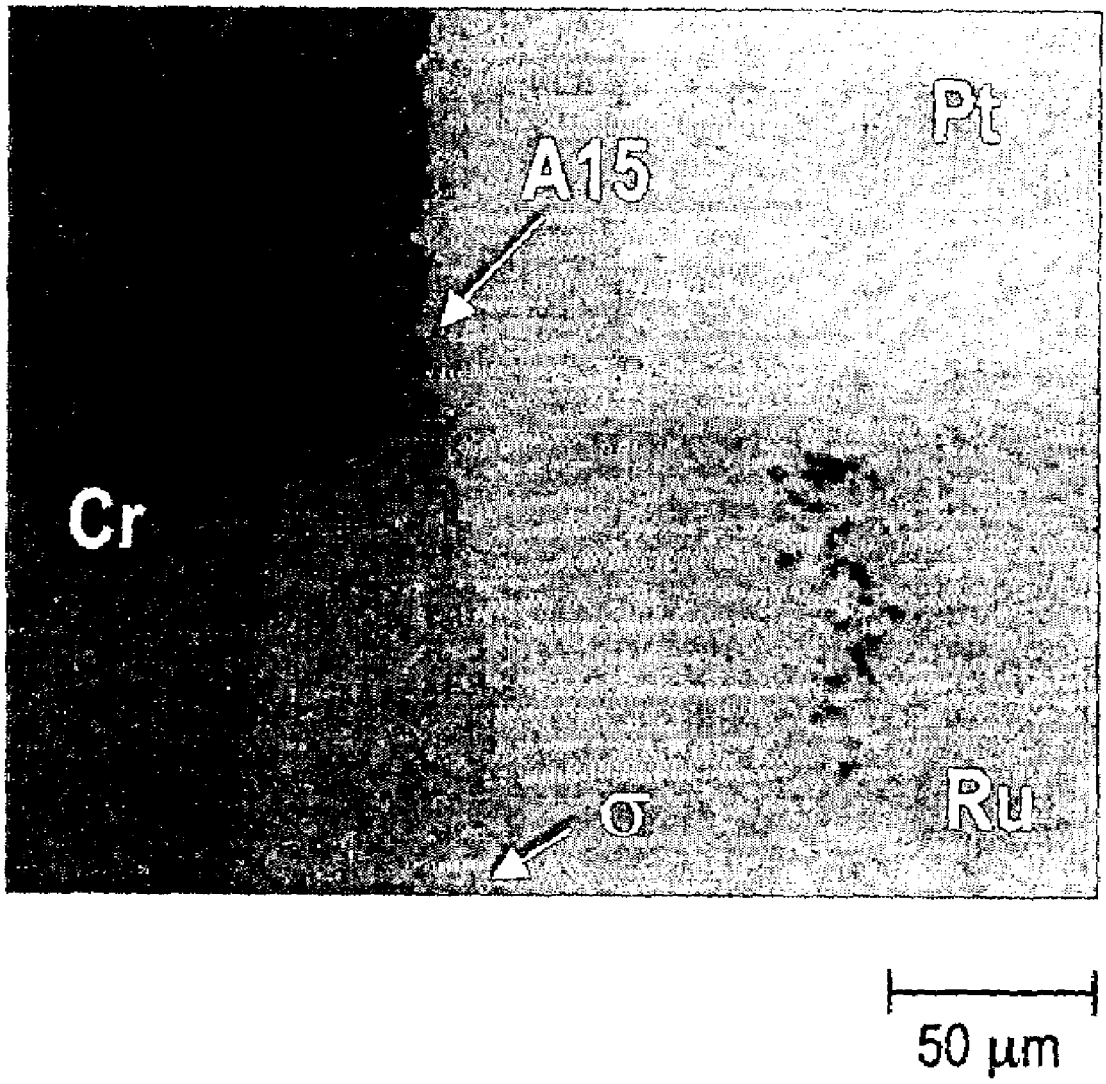
FIG. 3 illustrates a backscatter electron image of location 7 in the diffusion multiple of FIG. 1, wherein diffusion of Pt, Ru, and Cr has formed A15 and σ phases.
Figure 4:
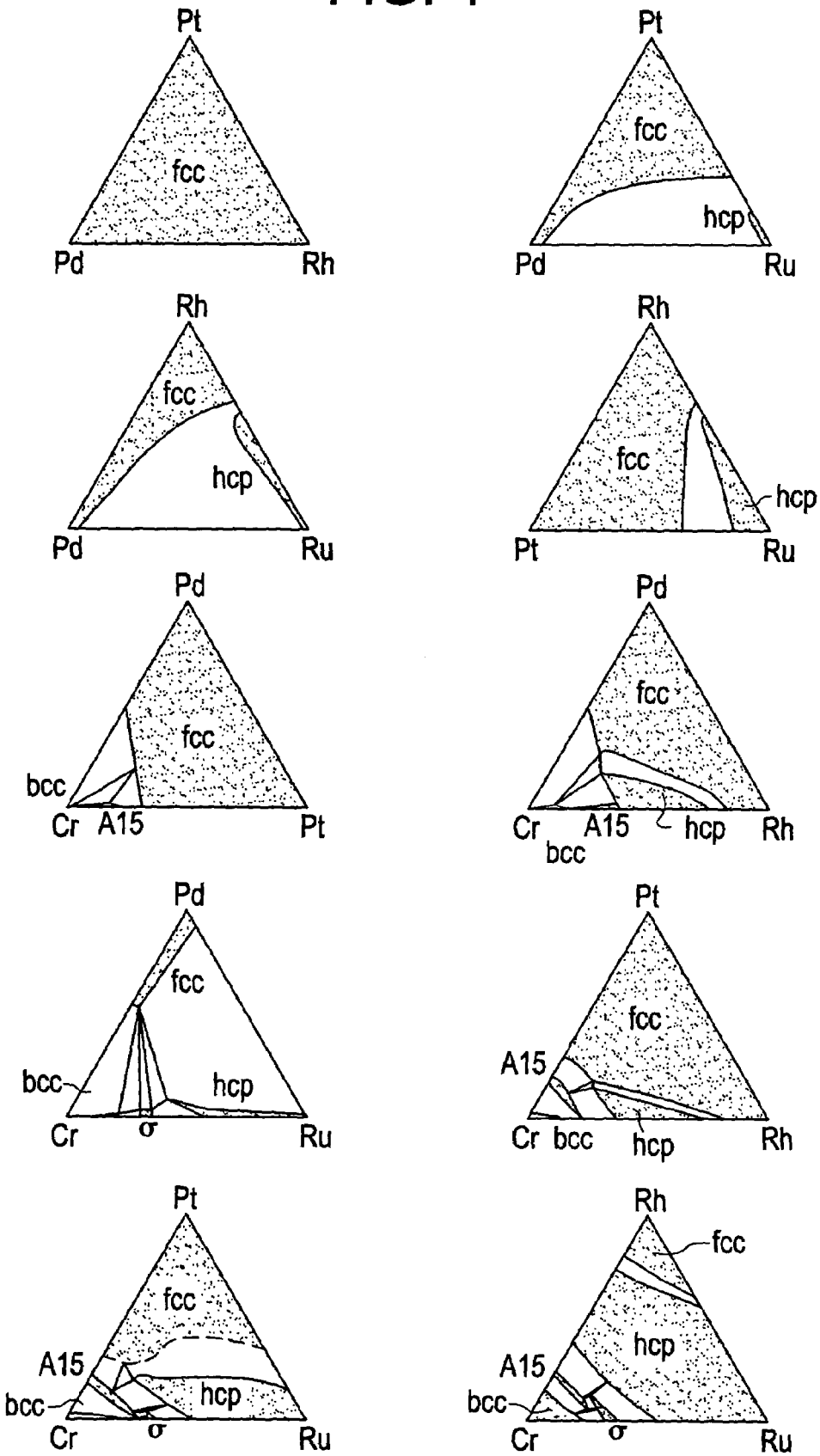
FIG. 4 illustrates ternary phase diagrams (isothermal sections at 1,200° C.) obtained from the diffusion multiple of FIG. 1.
Figure 5:
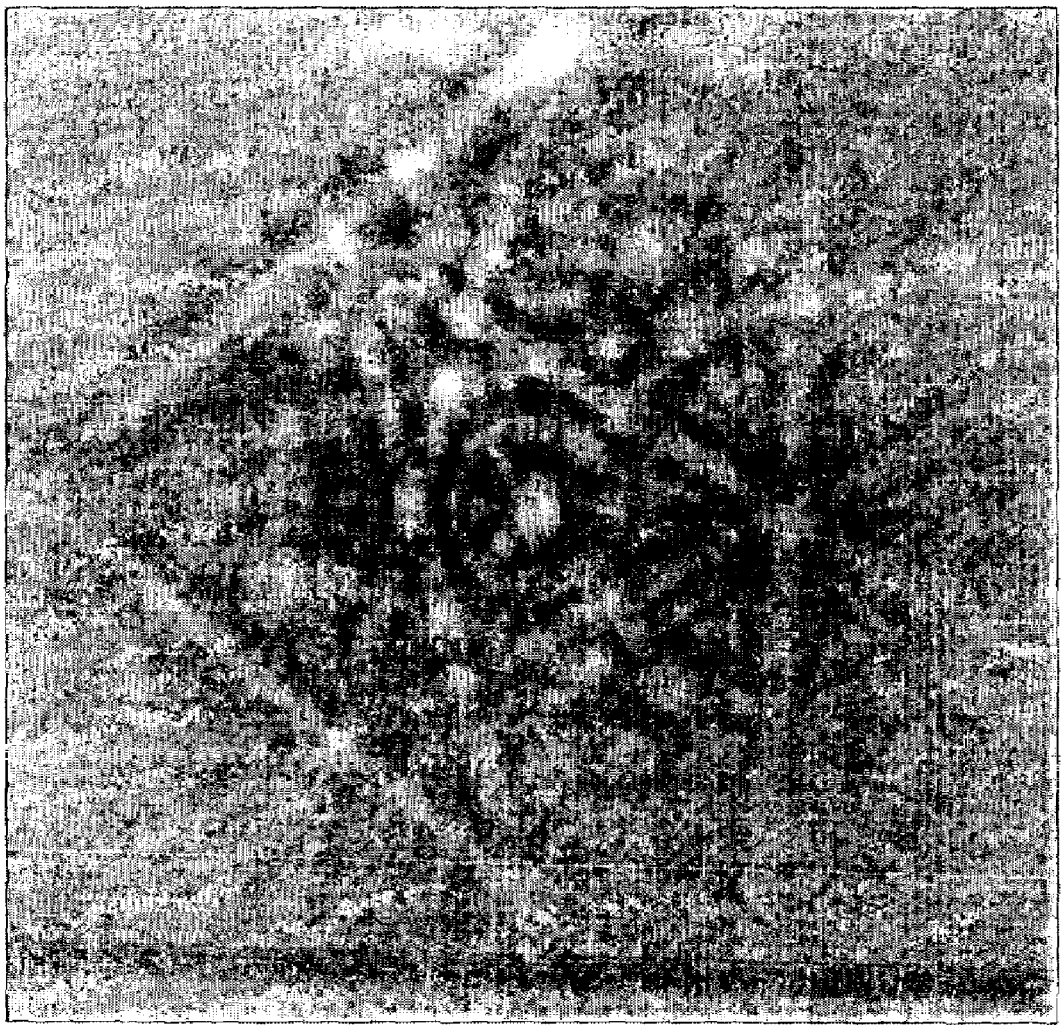
FIG. 5 pictorially illustrates a backscatter electron image at location 7 of FIG. 1.

The interdiffusion of elements at the tri-junction regions of the diffusion multiple allows the formation of all the intermetallic compounds and the generation of composition variations for all the single-phase regions. For example, as shown in FIG. 3, at location 7 of FIG. 1, where chromium, platinum, and ruthenium meet, the interdiffusion of chromium and platinum formed the A15 phase, and that of chromium and ruthenium formed the σ phase as shown. Close to the tri-junction region, ternary interdiffusion took place. The phases are identified using both compositional information from EPMA and crystal structure identification using EBSD techniques. EPMA allowed rapid mapping of the Cr—Pt—Ru ternary phase diagram. In fact, by performing EPMA and EBSD analyses of all the tri-junction regions in the diffusion multiple, isothermal section phase diagrams of ten ternary systems, were mapped as shown in FIG. 4. The phase diagrams are plotted in atomic percent axis with the scale removed for simplicity. An EBSD of the A15 phase is shown in FIG. 5. The differences in interdiffusion and mutual solubility are responsible for the gradations in gray scale evident in the face-centered cubic, body-centered cubic, and hexagonal close-packed solid solution regions in FIG. 3. Relative to one-at-a-time experimentation, the efficiency gain is significant since a single sample analysis would likely require greater than about 1,000 alloys to map the phase diagrams presented in FIG. 4.

Figure 6:
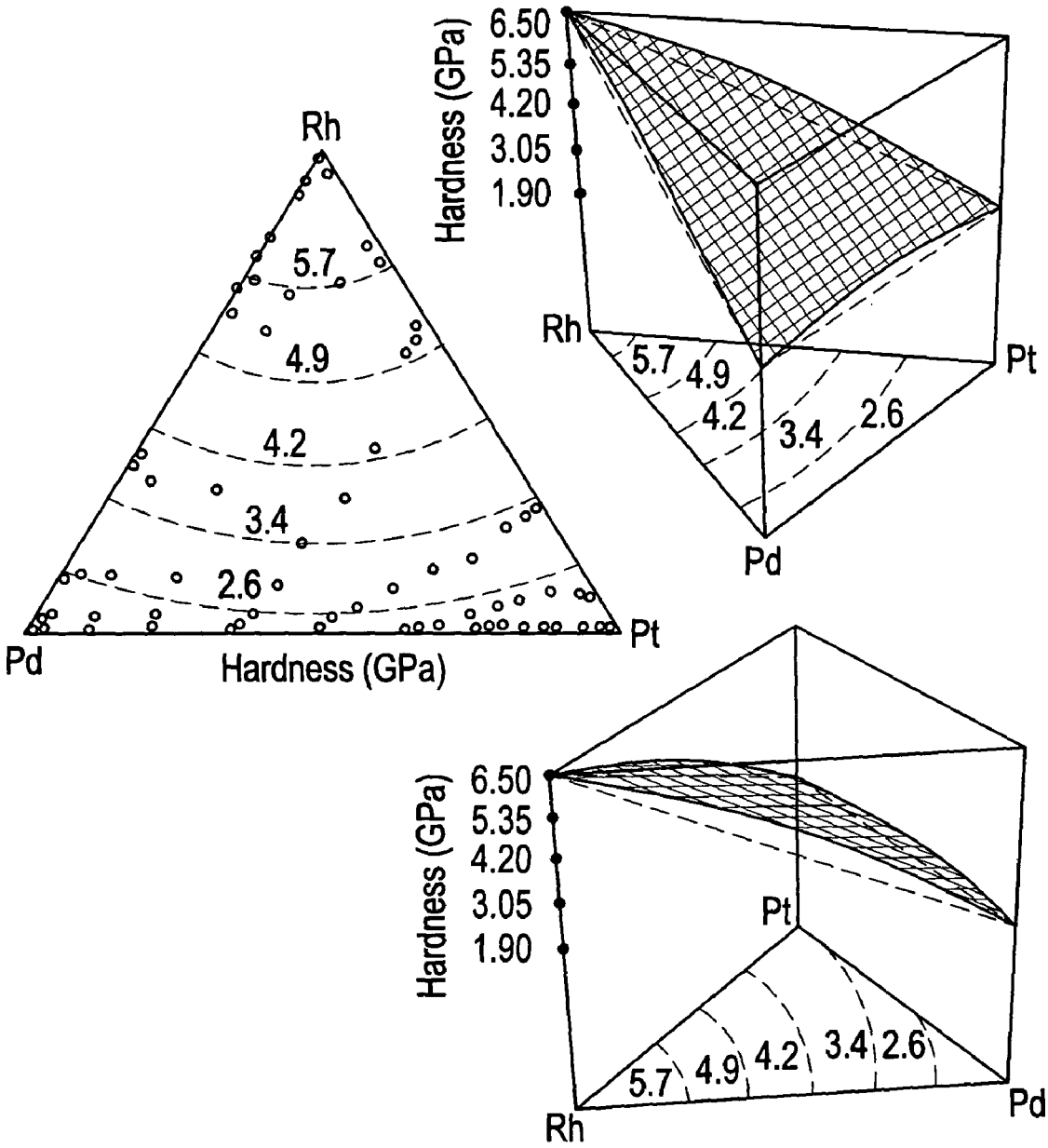
FIG. 6 graphically illustrates hardness variation with composition for the Pd—Pt—Rh ternary system.
Figure 7:
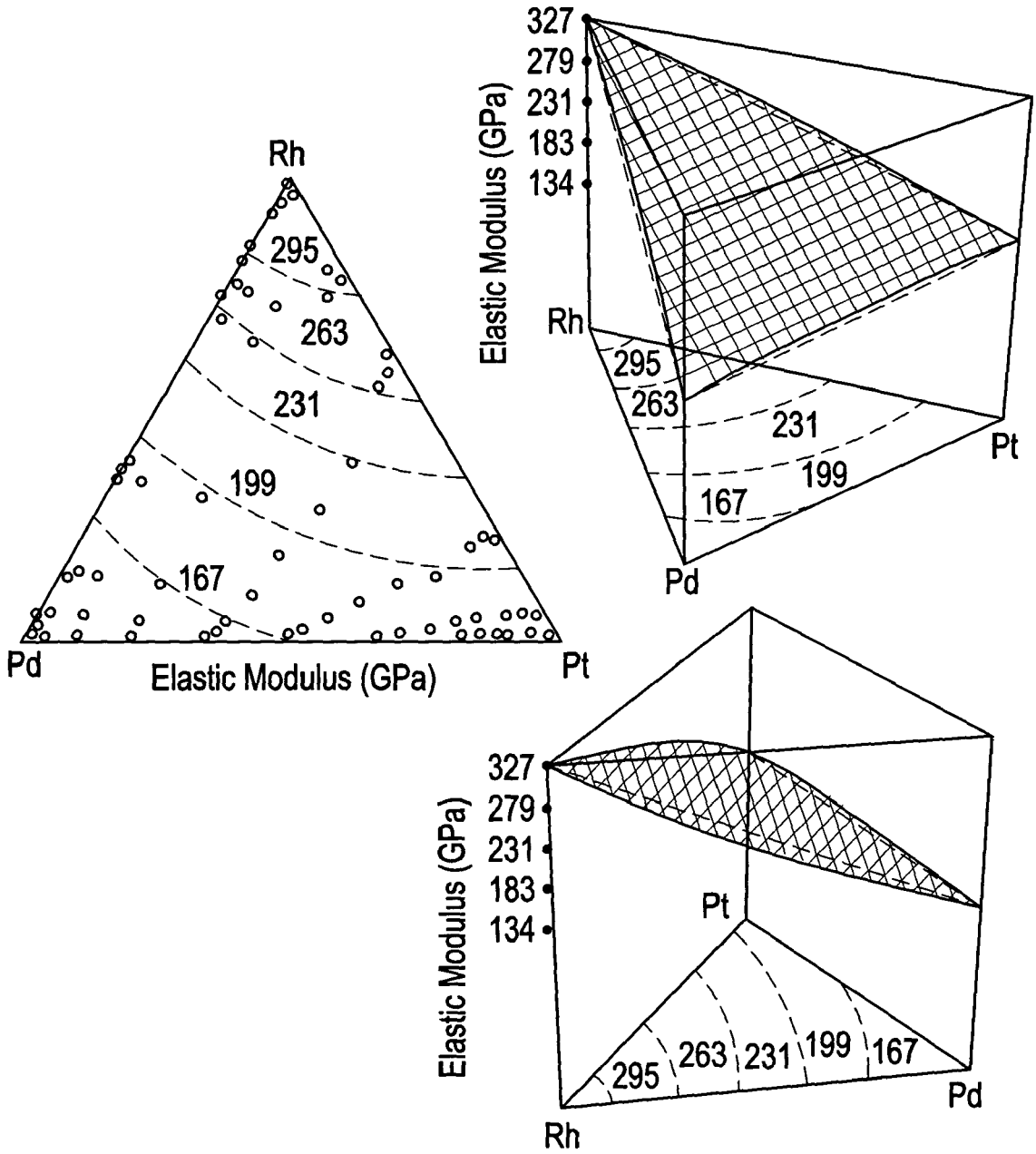
FIG. 7 graphically illustrates modulus variation with composition for the Pd—Pt—Rh ternary system.

Results for hardness and elastic modulus survey across the entire ternary system can also be provided. Nanoindentation is first made at various locations. An EMPA analysis is performed after nanoindentation in order to correlate the composition to the locations of the indents. FIGS. 6 and 7 graphically illustrate hardness and elastic modulus for a Pt—Pd—Rh ternary system of the diffusion multiple. With regard to FIG. 6, a two-dimensional contour plot shows the chemistries determined adjacent to each nanoindentation hardness measurement site, and the contour lines representing hardness levels interpolated from the individual measurements. Two different views of the three-dimensional (3-D) plot of the hardness plot are also included. The slight positive deviation from linear hardening is observed for Pd—Rh, which is consistent with data previously obtained for binary systems. The Pd—Pt and Pt—Rh systems also showed a positive deviation from linear hardening. Thus, the 3-D surface representing hardness in the Pd—Rh—Pt system shows positive deviation from a simple rule of mixtures linear hardening everywhere else in the hardening space. This has been determined efficiently for both alloying of elements with very different hardness (i.e., adding rhodium to Pd—Pt mixes) as well as for alloying of elements with very similar hardness (i.e., adding platinum to Pd—Rh mixes of near constant rhodium content).

Results for the elastic modulus survey across the entire Pd—Rh—Pt are shown in FIG. 7. Again, the contour lines representing modulus levels are interpolated from the individual measurements. Two different views of the 3-D plot of the modulus contour are also included to illustrate the variation across the system. The negative deviation from a linear rule of mixtures modulus previously noted for the Pd—Rh binary system was reproduced. However, the Pd—Pt and Pt—Rh systems showed different deviations from linear modulus, unlike the case for hardness. For Pt—Rh and Pt—Pd, the modulus deviates slightly positive from linearity. Thus, the 3-D surface representing the elastic modulus of the Pd—Rh—Pt system showed more complex deviation from a simple rule of mixtures than was the case for hardness. Again, this complex behavior has been determined efficiently for both alloying elements with very different moduli (i.e., adding Rh to Pd—Pt mixes) as well as for alloying elements with very similar moduli (i.e., adding Pt to Pd—Rh mixes of near constant Rh content).

Figure 8:
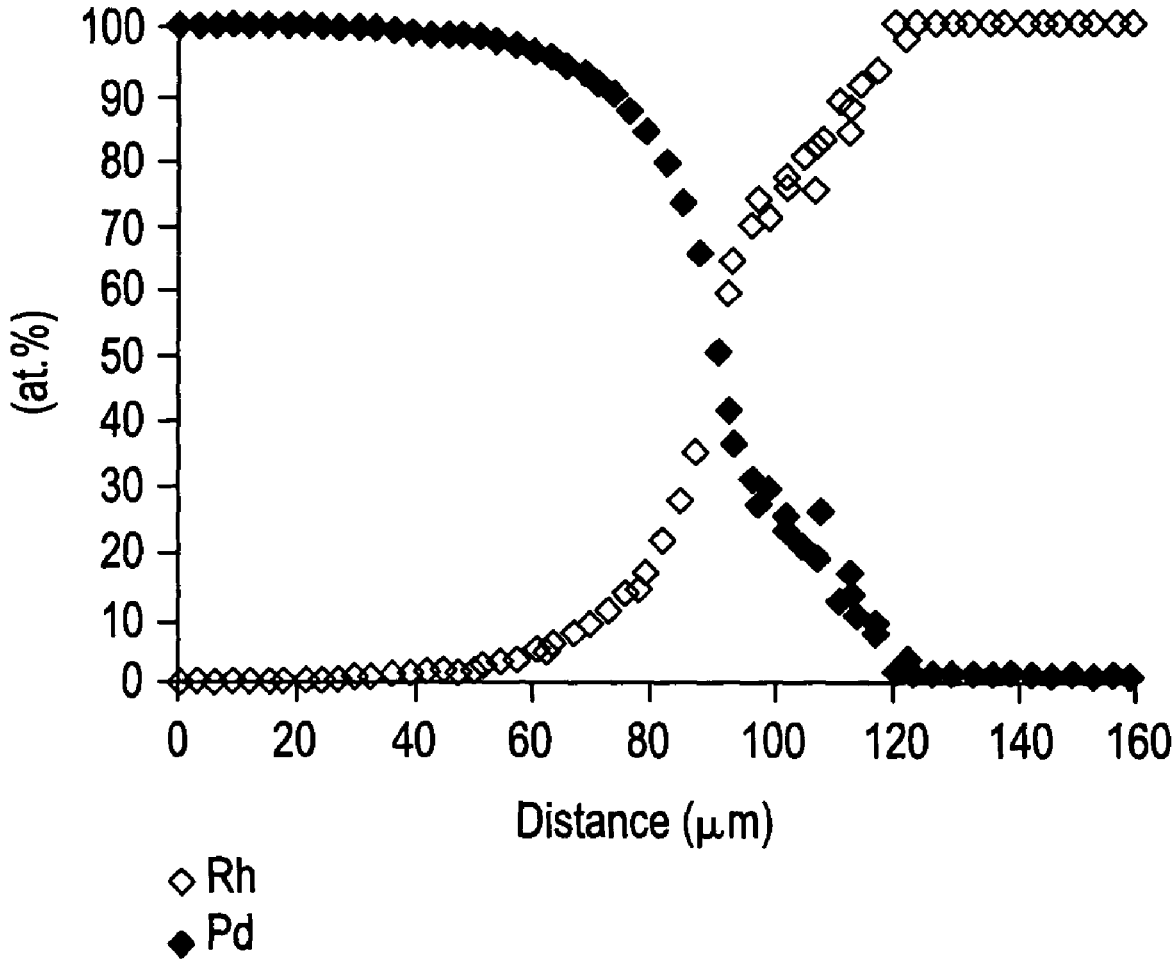
FIG. 8 graphically illustrates diffusion profiles for the Pd—Rh binary system.

The binary diffusion profiles such as those shown in FIG. 8 allow evaluation of diffusion coefficients as a function of composition. The diffusivity data can then be used for simulating the kinetics of materials processing and precipitation. The shapes of the diffusion profiles can be used to determine relative diffusivities. For example, the data presented in FIG. 8 indicates that the diffusivity of rhodium is much slower than that of palladium. As such, it is now possible to draw inferences and conclusion about ternary diffusion effects.

Figure 9:
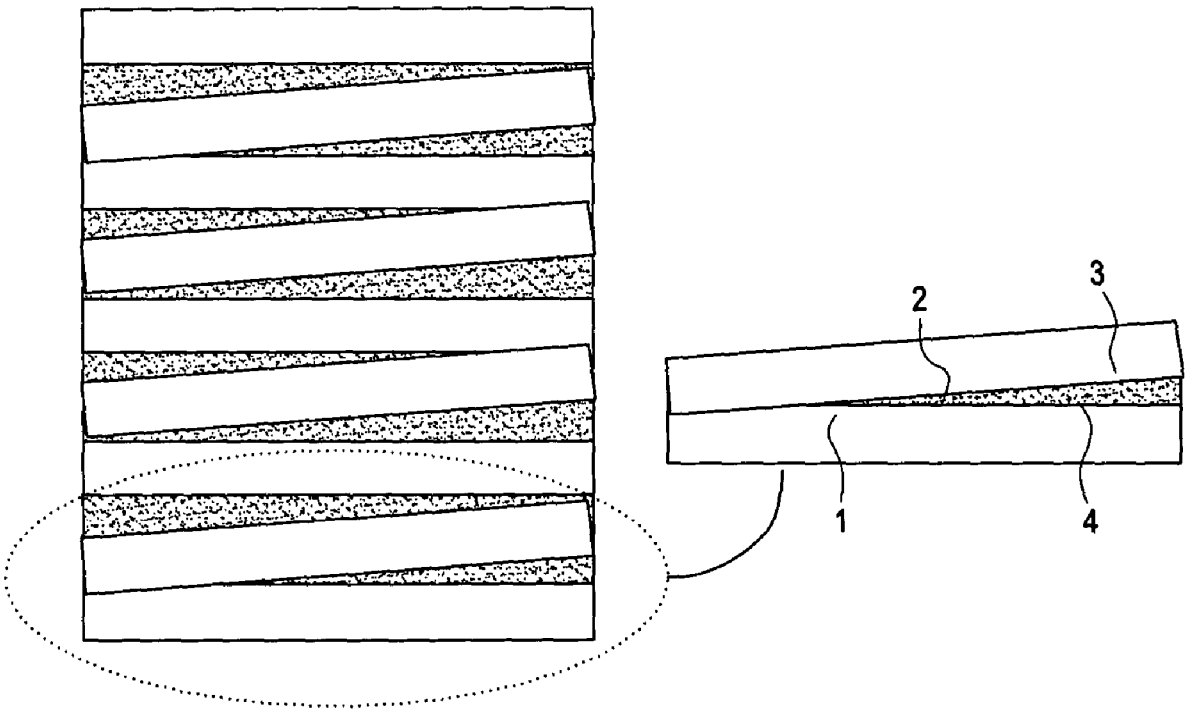
FIG. 9 illustrates a diffusion multiple arrangement suitable for analyzing alloy compositions for applicability as diffusion barriers.

Bulk diffusion multiples can be designed with many different shapes and forms to achieve different purposes. In another embodiment, a bulk diffusion multiple was arranged to screen effective diffusion barriers for high temperature coating applications. In this example, it was previously determined that Al from Al-rich coatings on Ni-based superalloys diffused into the superalloy substrate during high temperature service, thus consuming the substrate and reducing the Al content in the coating. Reducing the Al content also degraded the oxidation resistance of the coatings. It is desirable to have a diffusion barrier to retain high Al in the coating and preserve the substrate. To determine the most effective diffusion barrier composition, three diffusion multiples were fabricated, each containing as many as 12 different coating/substrate/barrier combinations. The geometry and arrangement of the diffusion multiples is shown in FIG. 9. To determine maximum effectiveness of the diffusion barrier, the following attributes were considered as potentially critical to its determination: 1) thermodynamic stability against both superalloy substrates and coatings, which usually contain NiAl (β) phase; 2) low Al solubility; 3) low diffusion coefficients; and 4) high elemental partitioning among the coating, substrate, and the diffusion barrier. It was not previously known which of these attributes were most critical. Moreover, the available thermodynamic and kinetic databases were insufficient for designing the diffusion barriers.

Slabs of single-phase NiAl were used as a proxy for the coating. Wedges of the diffusion barrier alloys were sandwiched between superalloys and NiAl pieces 3 mm thick. Several different superalloy compositions and many diffusion barriers were tested at the same time. The diffusion barriers were annealed at high temperatures for about 100 to about 1,000 hours. At location 1 in the enlarged cross sectional view of the diffusion multiple arrangement (FIG. 9), where there was no diffusion barrier, the interdiffusion between superalloy substrate and NiAl was severe and served as a baseline for comparing the effectiveness of the different barriers. At location 2 (FIG. 9), where a thin diffusion barrier was present, the effectiveness of the diffusion barrier could be assessed, and the stability of a thin diffusion barrier against interdiffusion of NiAl and the superalloy could be evaluated. In addition, an effective thickness of the diffusion barrier for preventing Al interdiffusion into the superalloy could be determined. At location 3 (FIG. 9), the stability/interaction between the diffusion barrier and the superalloy can be evaluated without the presence of NiAl. Similarly, at location 4 (FIG. 9), the stability/interaction between the diffusion barrier and NiAl could also be evaluated without the presence of the superalloy. Surprisingly, some of the barrier compositions tested had little interaction with the superalloys but had intensive interaction with NiAl, while other compositions behaved the opposite. In this manner, the critical attributes for effective diffusion barriers were readily identified.

While the use of bulk diffusion multiples for screening diffusion barriers is one example of the various potential applications, other applications include, but are not intended to be limited to, rapid mapping of phase diagrams, solution-hardening effects, binary diffusion matrices, and modulus dependency on composition and phases, to provide critical data for the computational design of materials.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A combinatorial process for production of material compositions from a single sample, comprising:

assembling a bulk diffusion multiple of at least three layers comprising metals, non-metals, metal oxides and/or alloys, into an arrangement, wherein each of the at least three layers has a thickness effective to provide bulk property behavior;

heating the arrangement at an elevated temperature and for a period of time effective to form interdiffusion regions at interfacial locations of dissimilar metals, non-metals, metal oxides, and/or alloys in the arrangement;

exposing the interdiffusion region; and evaluating properties of the single sample as a function of composition at the interdiffusion regions.

2. The combinatorial process of claim 1, wherein evaluating the properties comprises mapping phase diagrams, determining hardness as a function of composition, or determining modulus as a function of composition.

3. The combinatorial process of claim 1, wherein evaluating properties comprises applying an electron probe microanalysis technique at about the interdiffusion regions, an electron backscatter diffraction technique at about the interdiffusion regions, a nanoindentation technique at about the interdiffusion regions, or combinations comprising at least one of the foregoing techniques at about the interdiffusion regions.

4. The combinatorial process of claim 1, wherein heating the arrangement comprises hot isostatic pressing at an elevated temperature to form the interdiffusion regions.

5. The combinatorial process of claim 1, wherein evaluating the properties comprise determining electrical conductivity properties, magnetic properties, piezoelectric properties, optical properties, lattice parameters, thermal conductivity properties, corrosion properties, oxidation properties, or combinations comprising at least one of the foregoing properties.

6. The combinatorial process of claim 1, wherein the arrangement is inserted into a slot formed in a pure metal disc, wherein the arrangement is capped with a capping metal and sealed under a vacuum of about 1 nanotorr to about 1 millitorr.

7. The combinatorial process of claim 1, wherein the elevated temperature and the period of time is determined from binary phase diagrams and diffusion coefficients of the metals, metal oxides, and/or the alloys forming the interdiffusion regions.

8. The combinatorial process of claim 1, further comprising exposing the interdiffusion regions to a reactant to form compositions on an exposed surface of the interdiffusion region.

9. A combinatorial process for production of material compositions from a single sample, comprising:

forming a bulk diffusion multiple in the single sample, wherein the diffusion multiple comprises a plurality of interdiffusion regions at interfacial locations of dissimilar metals, non-metals, metal oxides, or alloys, and wherein the diffusion multiple comprises at least three layers of the metals, non-metals, metal oxides, or alloys; and evaluating properties of the bulk diffusion multiple as a function of composition at about the interdiffusion regions.

10. The combinatorial process of claim 9, wherein evaluating properties comprises applying electron probe microanalysis to determine phases of the interdiffusion regions as a function of composition.

11. The combinatorial process of claim 9, wherein evaluating properties comprises applying electron backscatter diffraction to determine crystal structure of the phases.

12. The combinatorial process of claim 9, wherein evaluating properties comprises applying nanoindentation to determine hardness and elasticity as a function of composition at the interdiffusion regions.

13. The combinatorial process of claim 9, wherein evaluating properties comprises applying a probe at various locations about the interdiffusion regions to provide chemical properties, mechanical properties, electrical properties, magnetic properties, piezoelectric properties, optical properties, thermal properties, and/or thermophysical properties as a function of composition.

14. The combinatorial process of claim 9, further comprising exposing the interdiffusion regions to a reactant to form compositions in the interdiffusion region.

15. A process for forming a bulk diffusion multiple-comprising:

layering at least three metals and/or non-metals and/or alloys and/or metal oxides to form a stack, wherein the stack comprises a plurality of interfacial contact surfaces of dissimilar metals, metal alloys, and/or metal oxides;

heating the stack to a temperature and for a period of time to form a plurality of interdiffusion regions at about the interfacial contact surfaces of the dissimilar metals, metal oxides, and/or alloys; and exposing surfaces of the interdiffusion regions for evaluation.

16. The process of claim 15, wherein heating comprises hot isostatic pressing to form the interdiffusion regions.

17. The process of claim 15, further comprising inserting the stack into a slot formed in a pure metal disk, prior to heating, wherein the stack accommodates dimensions of the slot.

18. The process of claim 17, further comprising sealing the metal disc and stack under a vacuum of about 1 nanotorr to about 1 millitorr.

19. The process of claim 17, further comprising capping the metal disk after inserting the stack into the slot and prior to heating.

20. The process of claim 15, wherein the at least three layers further comprise a wedge disposed between adjacent layers of the at least three layers, wherein the wedge comprises a metal, nonmetal, alloy, or metal oxide dissimilar from the metal, the-nonmetal, the alloy or the metal oxide of the adjacent layers.

21. A process for forming a bulk diffusion multiple comprising:

forming a bulk diffusion multiple in the single sample, wherein the diffusion multiple comprises a plurality of interdiffusion regions at interfacial locations of dissimilar metals, non-metals, metal oxides, or alloys, and wherein the diffusion multiple comprises at least three layers of the metals, non-metals, metal oxides, or alloys; and exposing surfaces of the interdiffusion regions for evaluation.

* * * * *